US005771953A

United States Patent [19]

Benthin

[11] Patent Number: 5,771,953

[45] Date of Patent: Jun. 30, 1998

[54] VERTICAL BLIND WITH A CRANK ROD

[75] Inventor: Siegfried Benthin, Bremerhaven, Germany

[73] Assignee: Benthin Aktiengesellschaft, Bremerhaven, Germany

[21] Appl. No.: 674,748

[22] Filed: Jul. 2, 1996

[30] Foreign Application Priority Data

Jul. 11, 1995 [DE] Germany ..... 195 25 140.7

[51] Int. Cl.[6] ..... E06B 9/38

[52] U.S. Cl. ..... 160/168.1 V; 160/176.1 V; 160/900

[58] Field of Search ..... 160/168.1 V, 173 V, 160/176.1 V, 177 V, 172 V, 900, 178.1 V

[56] References Cited

U.S. PATENT DOCUMENTS

| | | | |
|---|---|---|---|
| 3,463,219 | 8/1969 | Osterholz | 160/172 V |
| 3,878,877 | 4/1975 | Bruneau et al. | 160/168.1 V |
| 4,291,738 | 9/1981 | Grenga et al. | 160/176.1 V |
| 4,316,493 | 2/1982 | Arena | 160/168.1 V |
| 5,577,542 | 11/1996 | Hung | 160/177 V |

FOREIGN PATENT DOCUMENTS

| | | |
|---|---|---|
| OS 19 47 361 | 4/1970 | Germany . |
| 30 00 761 A | 7/1980 | Germany . |

OTHER PUBLICATIONS

LouverDrape® 800–523–9882 Apr. 19, 1995, Zirlon Wheeled System Beispiel.

*Primary Examiner*—David M. Purol
*Attorney, Agent, or Firm*—McGlew and Tuttle

[57] ABSTRACT

The present invention pertains to a vertical blind with a crank rod for horizontally displacing and for pivoting the slats, which can each be pivoted by approximately 180° in both directions up to a common plane by a pivoting gear in a slat carriage, which is horizontally movable in a support rail, about a vertical pivoting axis, wherein the crank rod can be coupled with a driving wheel, which is mounted in an end carriage and which is arranged on a pivot shaft, which meshes with a toothed wheel of the pivoting gear in the slat carriage in an axially displaceable manner, but in a manner adapted to rotate in unison. The toothed wheel can be moved about a toothed wheel approximately 180° from one side of the common plane of the slats to the opposite side in a curved guide, which is arranged at the end carriage.

4 Claims, 5 Drawing Sheets

VERTICAL BLIND WITH A CRANK ROD

FIELD OF THE INVENTION

The present invention pertains to a vertical blind with a crank rod for horizontally displacing and for pivoting vertical blind slats, each of the slats being pivotable by approximately 180° in both directions up to a common plane by means of a pivoting gear arrangement disposed in a slat carriage, the pivoting being about a vertical pivoting axis, wherein a crank rod can be coupled with a driving wheel, which is mounted in the slat carriage and which is arranged on a pivot shaft, which pivot shaft meshes with a toothed wheel of the pivoting gear arrangement in the slat carriage in an axially displaceable manner but in a manner adapted to rotate in unison.

BACKGROUND OF THE INVENTION

Vertical blinds are known which are operated manually by means of a crank rod, which can be coupled with the rotatable driving wheel in one of the two end carriages of the slat carriages, which are connected with one another under one another by means of spacers. The coupling is usually carried out on the driving wheel through an eyelet, in which a hook may be hung at the end of a crank rod, such that the crank rod is connected with the driving wheel in a movable manner, on the one hand, but in a manner adapted to rotate in unison, on the other hand. Both a pivoting of the slats by means of rotation and the opening and closing of the blind by means of pulling or pushing the end carriage are able to be carried out with this crank rod. In practical, prior-art embodiments even of horizontal blinds according to German Offenlegungsschrift DE-OS 19 47 361, e.g., according to the prospectus about the "Zirlon Wheeled System" of the firm of Louver Drape with No. 800-523-9882, the driving wheel, which is able to be coupled with the crank rod, is arranged laterally outside the slat in the end carriage, and even outside the closed blind, if the slats are aligned approximately parallel to one another in a common plane. The crank rod hangs freely next to the closed blind and is also able to be grasped from both sides of the blind (on the outside and on the inside); however, the installation width of the blind is not remarkably increased thereby. Above all, however, a wide gap of light, which the vertical blind is not able to cover, remains laterally next to the end slat. There are also, however, vertical blinds that are operated by means of a crank rod, which is moved forward far enough on the front side, so that it is located in the area of the end slat, but does not hinder this end slat during the pivoting. This means is not only difficult and complicated, but also does not resolve the requirement of alternately operating the closed blind from one of the two sides.

SUMMARY AND OBJECTS OF THE INVENTION

Accordingly, the object of the present invention is to design a vertical blind, which is operated by means of a crank rod, such that it is possible to operate the blind, especially the closed blind, from both sides, and the slats of the closed blind are able to completely cover the installation dimensions of the blind over its entire width.

According to the invention, a vertical blind is provided with a crank rod for horizontally displacing and for pivoting the vertical blind slats. The slats are each pivotable by approximately 180° in both directions up to a common plane by means of a pivoting gear arrangement. The pivoting gear arrangement is disposed in a slat carriage for movement of the slats about a vertical pivoting axis. A crank rod is provided which can be coupled with a driving wheel. The driving wheel is mounted to the slat carriage ad is arranged on a pivot shaft which meshes with a toothed wheel of the pivoting gear arrangement, in the slat carriage in an axially displaceable manner. And in a manner adapted to rotate in unison. The driving wheel is movable about an intermediate wheel by approximately 180° from one side of the common plane of the slats to an opposite side of the common plane of the slats, by following a curved guide which is arranged at the end of the carriage.

The invention also preferably provides that the driving wheel and the intermediate wheel form a gearing and the intermediate wheel is coupled with the pivot shaft by means of an angular double gear in such that they rotate in unison.

The distance of the axis of the driving wheel from the pivoting axis of the slat in the end of the carriage is preferably identical to or smaller than half the width of the slat.

By means of these design features, the crank rod is able to be arranged in the area of the end slat with relatively simple means, such that, when the blind is closed, the end slat extends beyond the crank rod, so that the slats of the closed blind cover the entire installation width of the blind or optionally even extend beyond it. At the same time, the blind may be operated alternately from the inside or from the outside, since, during the rotation of the crank rod, the slats pivot immediately about their vertical pivoting axis, so that the driving wheel is able to move from one side of the common slat plane to the other side, without being hindered by the end slat. With the blind closed, no gap of light remains on the side of the arrangement of the crank rod, such that the blind is completely closed and no gap of light remains.

In the design means for attaining the idea of the present invention, the driving wheel and the intermediate wheel preferably form a gearing, wherein the intermediate wheel is coupled with the pivot shaft by means of an angular bevel gear in a manner adapted to rotate in unison. This makes it possible to arrange the gearing and the other transfer elements for the rotation of the crank rod on the pivot shaft in a special component, which is later able to be connected with the end carriage, a pulling carriage or the like at the end of a vertical blind. Finally, a special feature of the present invention is that the distance of the pivoting axis from the longitudinal axis of the crank rod is able to be smaller than half the width of the slat, such that the slat, when the vertical blind is closed, extends laterally beyond the crank rod and may even extend beyond the installation dimensions of the vertical blind.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
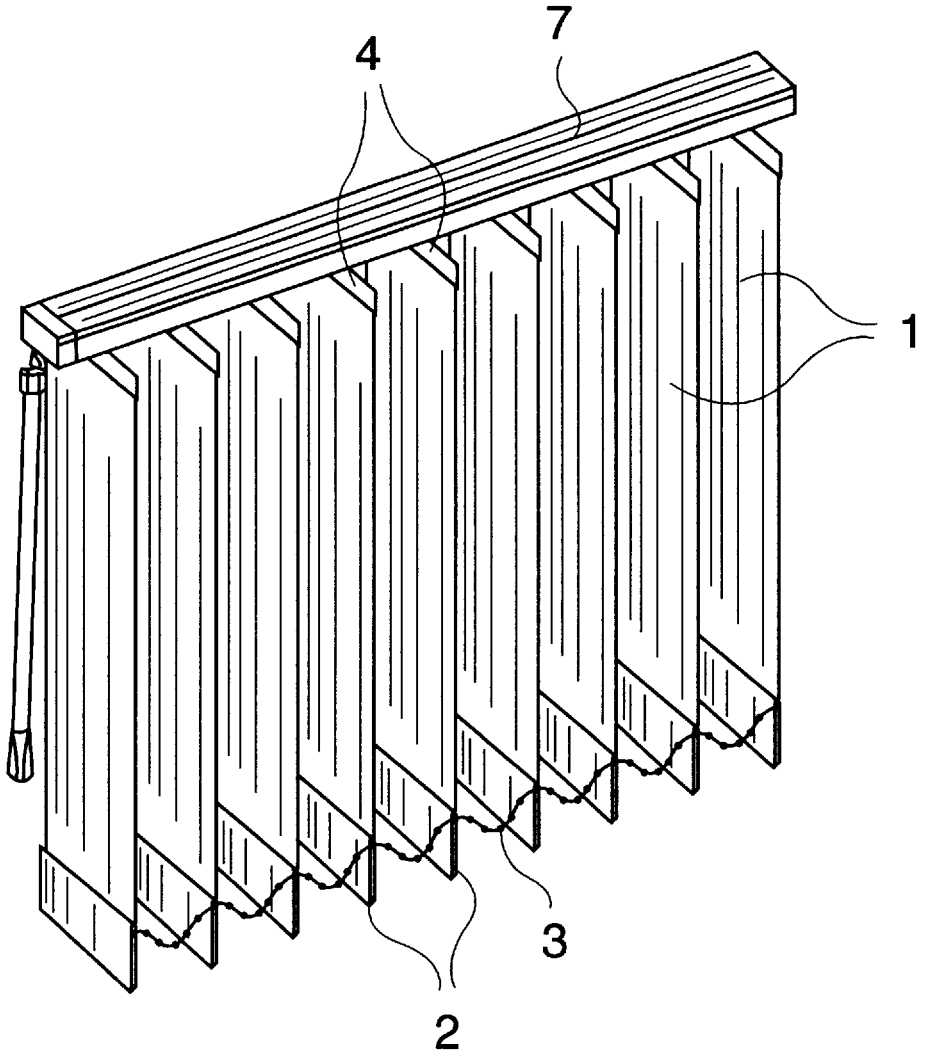
FIG. 1 is a perspective schematic view of a partly open vertical blind.
Figure 2:
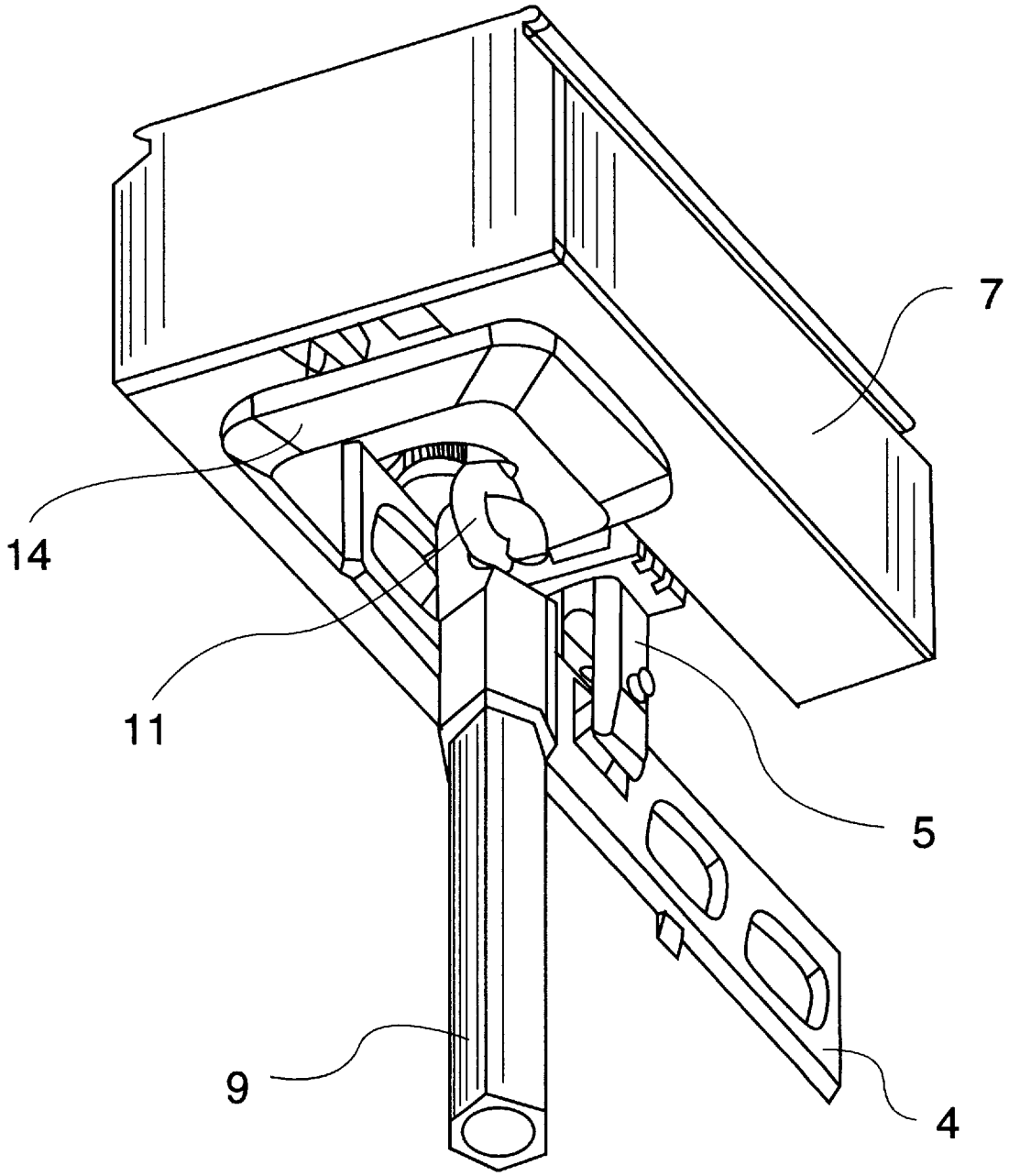
FIG. 2 is a perspective bottom view of the drive means.

According to the view in FIG. 1, the slats 1, which consist of strips of a suitable plastic or textile, are weighted by means of weights 2 on their lower end and are connected with one another by means of small chains 3. On the upper end of the slats 1 are attached slat holders 4, which have an eyelet approximately in the center for hanging a pivot pin 5 in a hook formation, which is pivotable in a slat carriage 6 about the vertical pivoting axis of the slat. The slat carriages 6 can be moved back and forth in both directions in an approximately horizontal attachable support rail 7. The slats 1 are pivoted about the axis of the pivot pin 5 by means of a pivot shaft 8 mounted in the support rail 7, which pivot shaft meshes axially displaceably with a toothed wheel of a bevel gear in all slat carriages, but is rigidly coupled with the toothed wheel in the direction of rotation. All slat carriages 6 are connected with one another in the longitudinal direction of the support rail 7 by means of spacers, which are not shown in the drawing.

Figure 3:
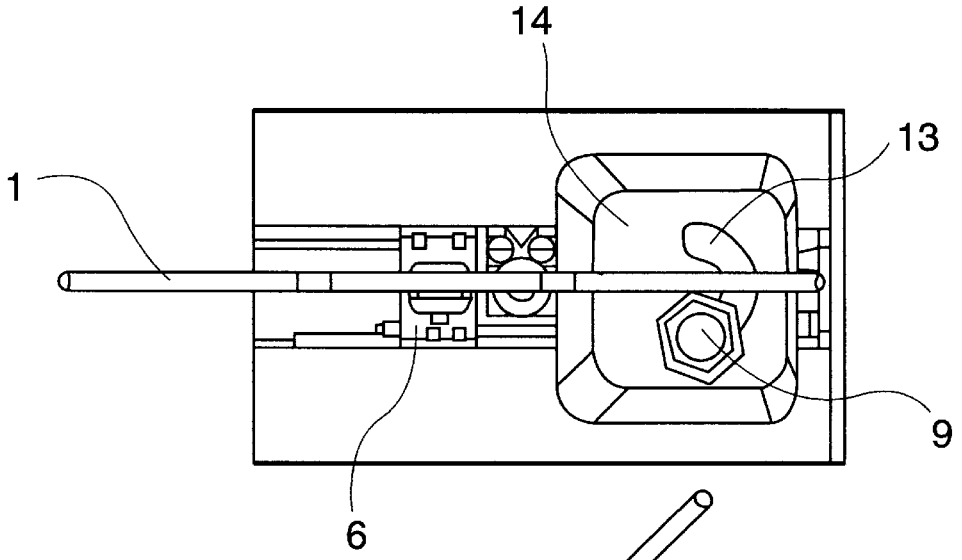
FIG. 3 is a bottom view of the drive means with the blind closed.
Figure 4:
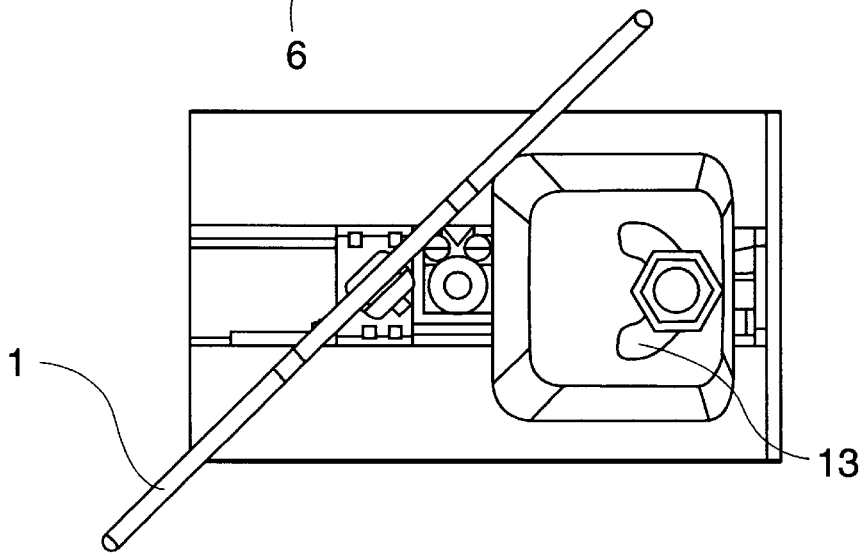
FIG. 4 is a bottom view corresponding to FIG. 3 with the blind partly open.
Figure 5:
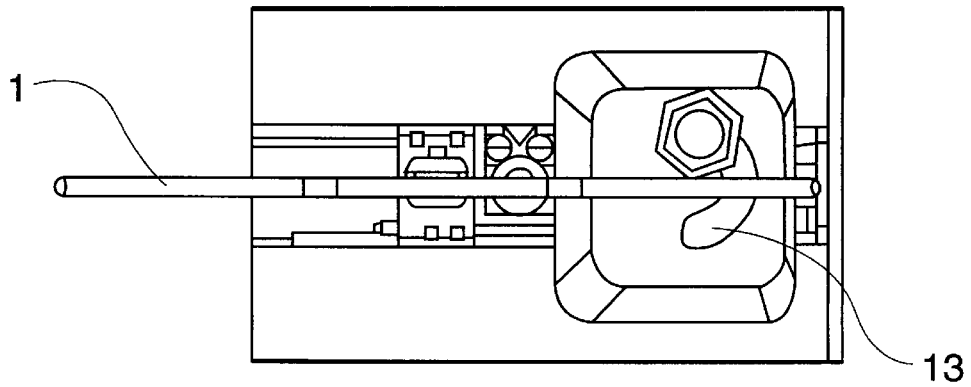
FIG. 5 is a bottom view of a blind closed by means of rotating the slats in the opposite direction.
Figure 6:
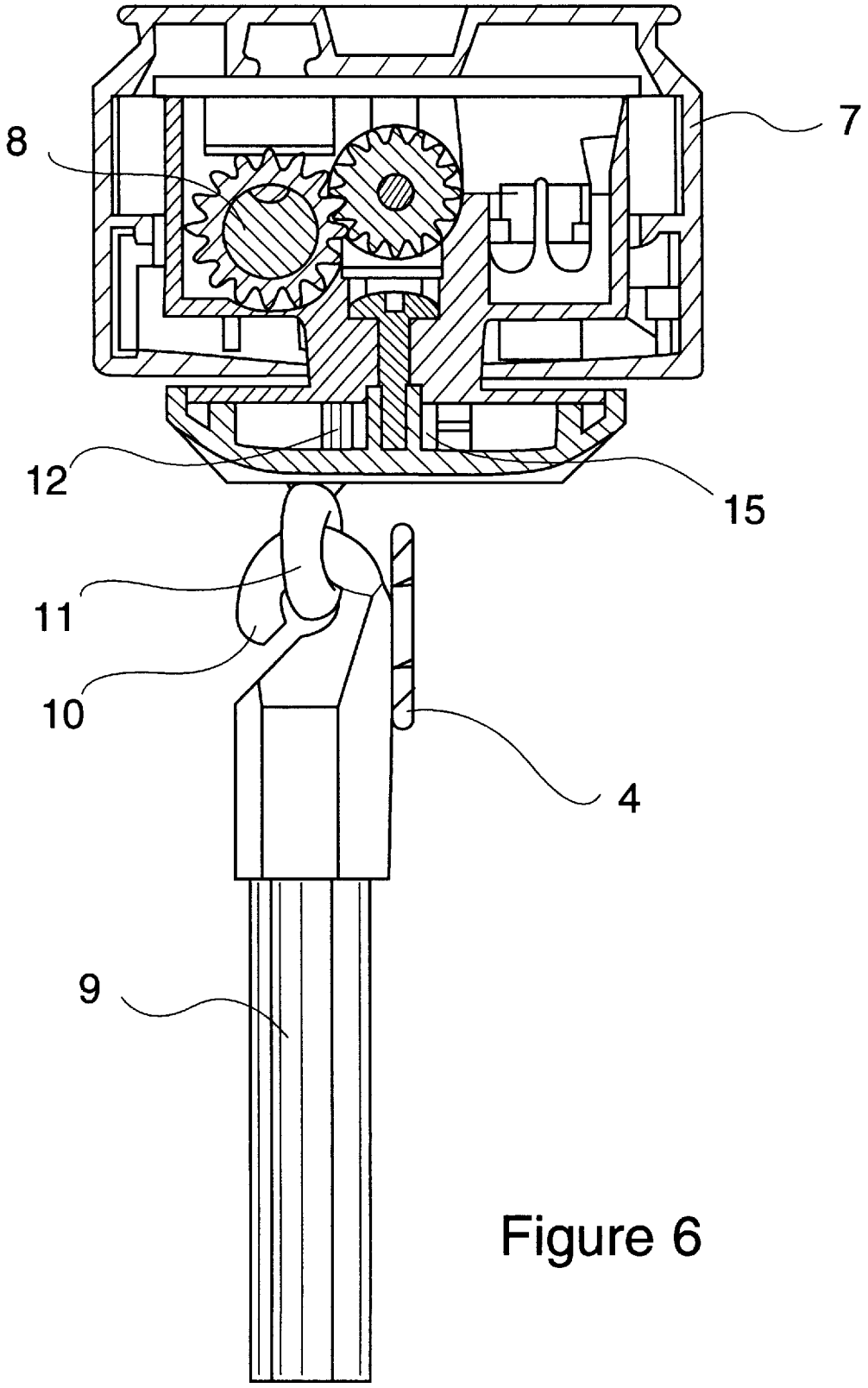
FIG. 6 is a cross section through the drive means according to line D—D in FIG. 7.
Figure 7:
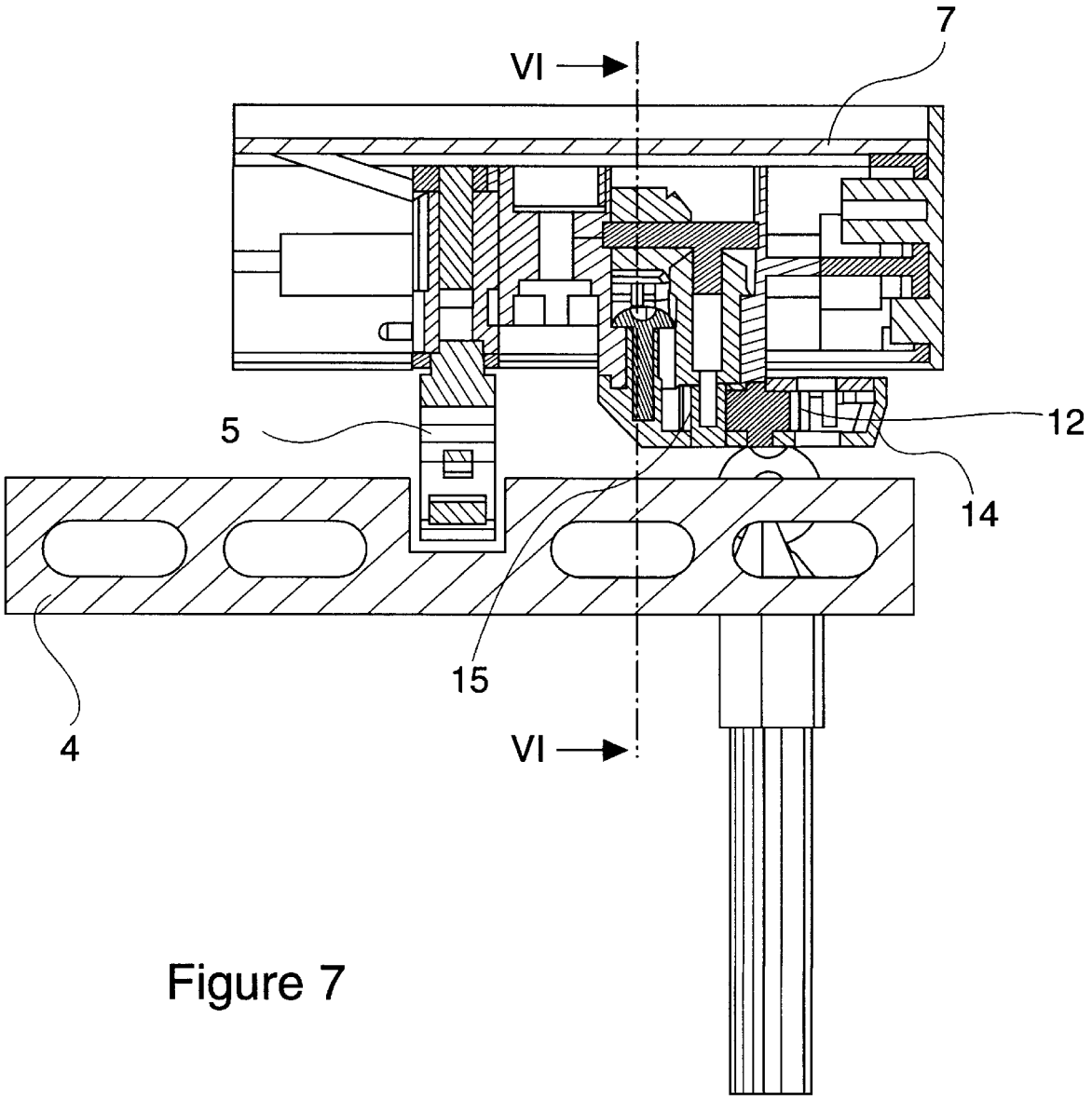
FIG. 7 is a longitudinal section through the drive means of the blind.

The vertical blind is driven by means of a crank rod 9, which is hung in an eyelet 11, which has a hook 10 formed on its end and is rigidly connected to a toothed wheel 12. The toothed wheel 12 is movable in a curved guide 13 of a component 14, which component is rigidly connected with an end carriage. The approximately semicircular curved guide 13 is arranged in the center so that its ends extend on both sides from the common plane of the slats in the closed position of the blind, as it is shown in FIGS. 3 through 5. The toothed wheel 12, which is movable in the guide 13, meshes, with its toothing, with a toothed intermediate wheel 15, which is rotatably mounted in the component 14. The toothed wheel 12, which acts as a driving wheel, and the intermediate wheel 15 form a gearing, and a bevel gear (not shown in the drawing) transfers the torque of the intermediate wheel 15 to the pivot pin 5. Depending on the direction of rotation of the crank rod 9, the toothed wheel 12 moves in the curved guide 13 about the toothed intermediate wheel 15 up to the final position either according to FIG. 3 or according to FIG. 5. Taking the view in FIG. 3 as the starting point, when the crank rod 9 is rotated counterclockwise, the slats are pivoted in the opening direction at the same time, so that the toothed wheel 12 is able to be freely moved up to the other final position in the curved guide 13. Further rotation of the crank rod 9 leads to a pivoting of the slats 1 by approximately 180°, until a closed blind position corresponding to the view in FIG. 5 is again reached. The rotation of the slat 1 arranged at the end is thus not hindered by the crank rod 9, which is hanging down. The crank rod 9 may hang alternately on the inside or on the outside of the closed blind. By means of the features of the present invention, the distance of the driving axis from the pivoting axis of the slat in the end carriage may be identical to or smaller than half the width of the slat, such that the slat extends laterally beyond the crank rod 9 when the blind is closed. Thus, a gap of light is completely prevented when the blind is closed.

While a specific embodiment of the invention has been shown and described in detail to illustrate the application of the principles of the invention, it will be understood that the invention may be embodied otherwise without departing from such principles.

What is claimed is:

1. A vertical blind with a crank rod for horizontally displacing and for pivoting vertical blind slats, with each slat being pivotable by approximately 180° in both directions up to a common plane, the vertical blind comprising:

a slat carriage;

a pivoting gear arrangement disposed in the slat carriage for pivoting the slats about a vertical pivoting axis;

a driving wheel mounted to said slat carriage;

a pivot shaft, said driving wheel being arranged on said pivot shaft, said pivoting gear arrangement including an intermediate wheel, said driving wheel meshing with said intermediate wheel for rotating in unison, said driving wheel being movable about said intermediate wheel approximately 180° from one side of said common plane of said slats to an opposite side of said common plane of said slats; and means defining a curved guide arranged at an end of said carriage for guiding said driving wheel during movement from one side of said common plane to the opposite side of said common plane.

2. A vertical blind according to claim 1, wherein said driving wheel and said intermediate wheel form a gearing, said intermediate wheel being coupled to said pivot shaft by means of an angular bevel gear for rotation in unison.

3. A vertical blind according to claim 1, wherein said slat has a pivoting axis and said driving wheel is provided with an axis spaced from said pivoting axis by a distance which is one of identical to or smaller than half a width of said slat.

4. A vertical blind with a crank rod for pivoting vertical blind slats, the vertical blind comprising:

a slat carriage;

a pivoting gear arrangement disposed in the slat carriage with an intermediate wheel for pivoting the slats about a vertical pivoting axis and into a common plane;

a driving wheel mounted to said slat carriage, said driving wheel being arranged on the crank rod, said driving wheel meshing with said intermediate wheel for rotating in unison, said driving wheel being movable around said intermediate wheel approximately from one side of said common plane of said slats to an opposite side of said common plane of said slats; and means defining a curved guide arranged at an end of said slat carriage for guiding said driving wheel during movement from one side of said common plane to said opposite side of said common plane.

* * * * *